US006234353B1

(12) United States Patent
Light

(10) Patent No.: US 6,234,353 B1
(45) **Date of Patent: *May 22, 2001**

(54) DISPENSING TUBE COMPRESSOR

(76) Inventor: Homer E. Light, 6050 School Creek La., Annville, PA (US) 17003

( * ) Notice: Subject to any disclaimer, the term of this patent is extended or adjusted under 35 U.S.C. 154(b) by 0 days.

This patent is subject to a terminal disclaimer.

(21) Appl. No.: 09/537,845

(22) Filed: Mar. 29, 2000

Related U.S. Application Data

(60) Provisional application No. 60/128,938, filed on Apr. 13, 1999.

(51) Int. Cl.[7] ..... B65D 35/28
(52) U.S. Cl. ..... 222/103
(58) Field of Search ..... 222/95, 101, 103

(56) References Cited

U.S. PATENT DOCUMENTS

| | | | | |
|---|---|---|---|---|
| Re. 35,587 | * | 8/1997 | Okamra et al. | 222/100 |
| 2,148,321 | | 2/1939 | Oplinger | 221/60 |
| 2,643,029 | | 6/1953 | Chapman et al. | 222/103 |
| 2,790,579 | | 4/1957 | Woldorf | 222/103 |
| 2,830,736 | | 4/1958 | Schneider | 222/103 |
| 3,219,238 | | 11/1965 | Borkenhagon et al. | 222/100 |
| 3,291,345 | | 12/1966 | McCombs | 222/103 |
| 3,961,727 | | 6/1976 | Spears | 222/103 |
| 4,019,656 | * | 4/1977 | Spears | 222/103 |
| 4,365,727 | | 12/1982 | Shmelkin | 222/97 |
| 5,743,434 | * | 4/1998 | Light | 222/103 |

* cited by examiner

*Primary Examiner*—Kevin Shaver
*Assistant Examiner*—Stephanie L. Willatt
(74) *Attorney, Agent, or Firm*—Michael F. Petock, Esq.

(57) ABSTRACT

An apparatus for compressing flowable materials out of a tube includes a base member provided with a substantially flat surface and a rising flange at a first end. A compressing member is pivotally mounted to the base member in proximity to the first end and is provided with a compressing flat and curved surface. The compressing member is pivotally mounted to the base member such that a constant spacing is maintained between the curved surface and the base member for a portion of the rotation of the compressing member. This constant spacing is substantially equal to the thickness of the compressed layers of the tube. A hole may be formed in the flat surface of the base member near a second end of the base member to receive the outlet of the tube being compressed so that substantially all of the flowable material contained within the tube may be forced through the outlet of the tube. Friction enhancing structure may be provided on the curved surface of the compressing member. The curved surface may span an arc of approximately 90 degrees to enable ease of insertion and removal of the tube.

13 Claims, 2 Drawing Sheets

FIG. 1
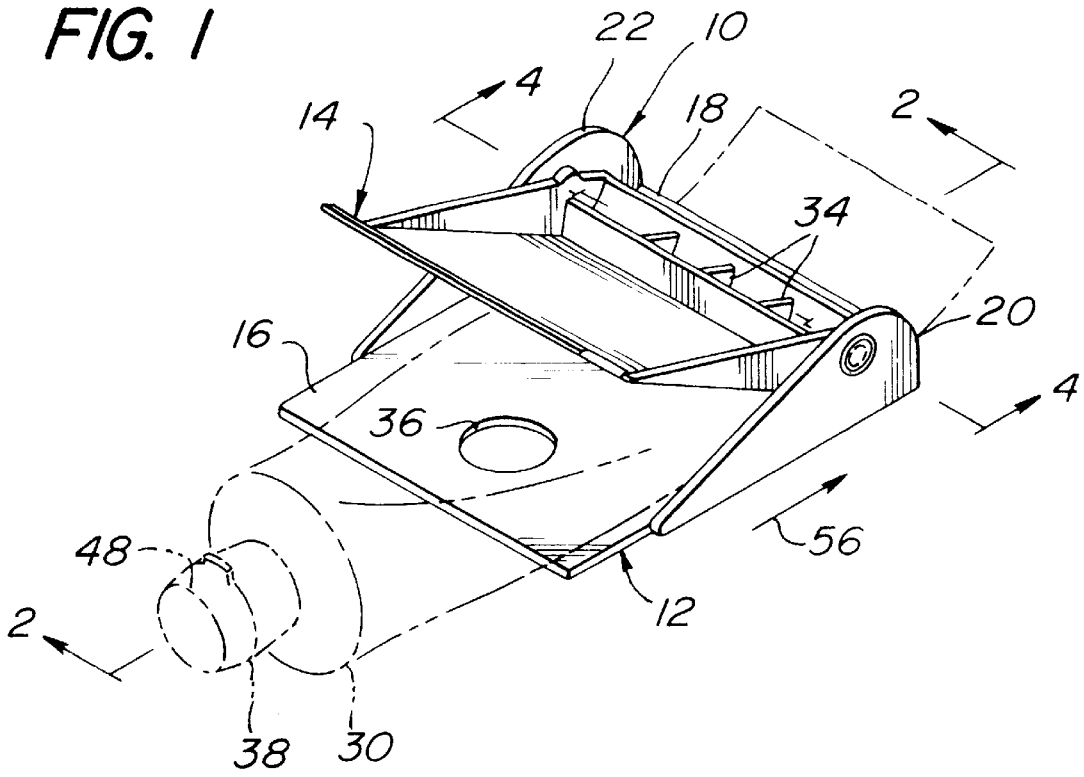
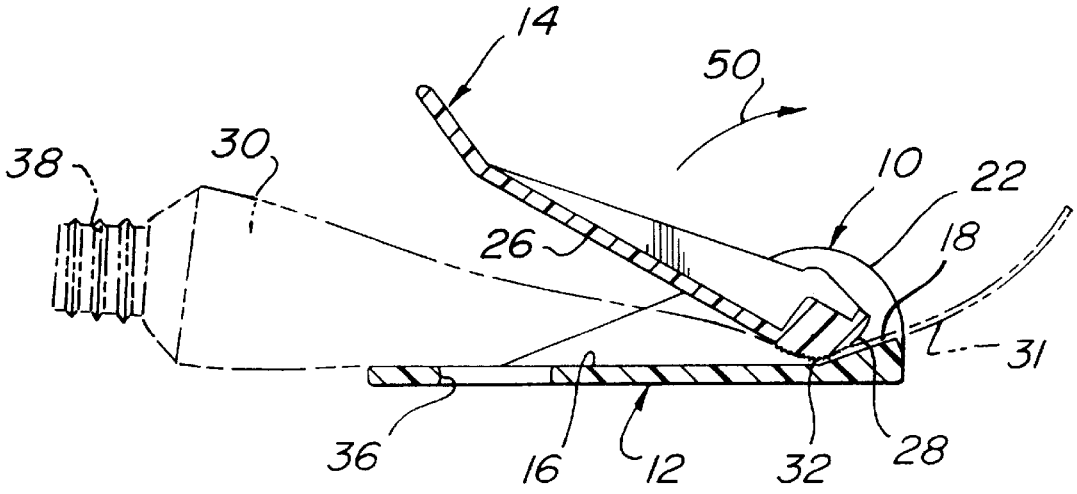
FIG. 2

DISPENSING TUBE COMPRESSOR

CROSS REFERENCES TO RELATED APPLICATIONS AND PATENTS

This application claims the benefit of U.S. Provisional Application No. 60/128,938, filed Apr. 13, 1999. This application incorporates by reference the teachings of the Inventor's U.S. Pat. No. 5,743,434 entitled "Collapsible Tube Compressing Device."

FIELD OF THE INVENTION

The present invention relates to a new and improved dispensing tube compressor. More particularly, the present invention relates to an improved dispensing tube compressor which is effective, inexpensive, has an uncomplicated structure, and which enables the compression of substantially all of the flowable material contained within and to be dispensed from the tube.

BACKGROUND OF THE INVENTION

There has been a need for an effective, simple and inexpensive apparatus for compressing a flowable material out of a collapsible dispensing tube. There has been a need for an apparatus wherein the material may be uniformly and substantially completely compressed from the closed end of the tube to the outlet of the tube.

Various attempts have been made in the past to produce such an apparatus including those shown in U.S. Pat. No. 2,148,321—Oplinger; U.S. Pat. No. 2,790,579—Woldorf; U.S. Pat. No. 2,643,029—Chapman et al; U.S. Pat. No. 2,830,736—Schneider; U.S. Pat. No. 3,219,238—Borkenhagen et al; U.S. Pat. No. 3,961,727—Spears; U.S. Pat. No. 4,365,727 Shmelkin; U.S. Pat. No. 3,291,345—McCombs, as well as U.K. Patent 974,849 and Swedish Patent 124,759.

SUMMARY OF THE INVENTION

An advantage of the present invention is that it provides an apparatus for compressing a flowable material out of a tube wherein substantially all of the material may be compressed through the nozzle or outlet of the tube.

Another advantage of the present invention is that the apparatus of the present invention may be utilized with any type of flowable material including toothpaste, creams, caulking materials, adhesives or any other flowable material packaged in a collapsible tube for dispensing of the flowable material.

Another advantage of the present invention is that it is effective, cost efficient and has an uncomplicated structure. The apparatus of the present invention is effective for compressing the tube in a uniform manner from its closed end to its outlet end wherein only the thickness of the tubing material remains. The present invention is cost effective in that the present invention may be manufactured at low cost and is effective in removing substantially all of the flowable material out of the tube. Even the last remaining material may be substantially completely compressed by turning the outlet to an angle of approximately 90 degrees to the remainder of the tube and compressing the collapsible portion of the tube such that the flowable material is expressed through the outlet.

Briefly and basically in accordance with the present invention, an apparatus for compressing flowable material out of a tube is provided. The apparatus includes a base member wherein the base member includes at a first end a flange rising at a predetermined angle to the flat surface of the base member. A compressing member is pivotally mounted to the base member in proximity to the first end. The compressing member is provided with a compressing flat surface and a compressing curved surface. The curved surface forms in cross section a sector of substantially circular shape having an axis of rotation coincident with an axis of rotation of the pivotally mounted compressing member. The compressing member is pivotally mounted to the base member such that a constant spacing is maintained between the curved member and the base member and the constant spacing is substantially equal to the thickness of the compressed layers of the tube.

In a preferred embodiment, a hole is formed in the flat surface of the base member near a second end of the base member. This hole is adapted to receive the outlet of the tube where the outlet is bent substantially at a right angle to the tube.

In a preferred embodiment, the entire apparatus is constructed of a moldable synthetic plastic.

Another aspect of the invention, a friction enhancing structure is provided on the curved surface of the compressing member, which is preferably ridges running parallel to the axis of rotation of the curved surface of the compressing member.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 1 is a perspective view of an apparatus in accordance with the present invention including a compressible tube shown in dotted outline form.

FIG. 2 is a cross sectional view taken along line 2—2 of FIG. 1.

DETAILED DESCRIPTION OF THE PREFERRED EMBODIMENTS

Figure 3:
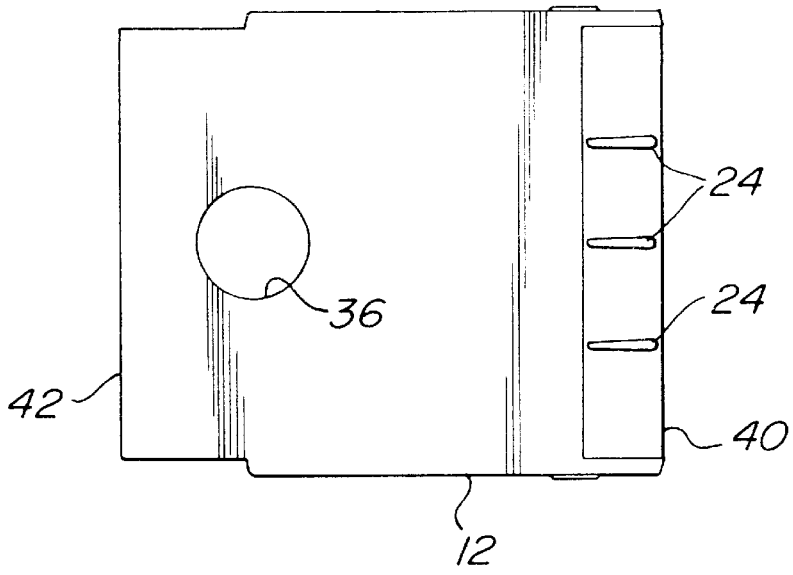
FIG. 3 is a bottom plan view of the base member of the apparatus shown in FIGS. 1 and 2.

Referring now to the drawings, wherein like numerals indicate like elements, there is shown in FIGS. 1 and 2 an improved dispensing tube compressor 10 in accordance with the present invention. Tube compressor 10 includes a base member 12 and a compressing member 14. Base member 12 includes a flat surface 16 and a flange 18 rising at a predetermined angle to the flat surface 16 (i.e. a rise of 1 for a run of 3). In a presently preferred embodiment, by way of example, but not by way of limitation, the angle that flange 18 makes with the flat surface is approximately 160.5 degrees or, in other words, flange 18 rises at approximately a 19.5 degree angle from flat surface 16. It is understood that other suitable angles may be utilized. Flange 18 is reinforced or supported by ribs 24 as may be best seen in FIG. 3. Ribs 24 prevent flexing or bending of flange 18 during compression.

Base member 12 is provided with perpendicularly rising side members 20 and 22. Pivotally mounted within side members 20 and 22 is compressing member 14. Compressing member 14 is provided with a flat surface 26 and a curved surface 28. Curved surface 28 forms in cross section a sector of substantially circular shape as may be best seen in FIG. 2.

In the presently preferred embodiment, the curved surface may be for a sector of 90 degrees or slightly more as illustrated in FIG. 2. However, it is understood that this is not a limitation and that the sector could be 180 degrees or more. However, as presently contemplated in a preferred working embodiment, a sector of approximately 90 degrees is adequate and preferred. As discussed below, providing a curved surface having a sector of approximately 90–120 degrees provides the advantage of an increased opening between compressing member 14 and base member 12 when compressing member 14 is rotated clockwise in the direction of arrow 50 such that curved surface 28 is no longer juxtaposed base member 12 comprised particularly of the junction area between flat surface 16 and flange surface 18. This increases the ease of insertion or removal of tube 30.

Curved surface 28 has an axis of rotation coincident with the axis of rotation of the pivotally mounted compressing member. In other words, compressing member 14 with its curved surface 28 is pivotally mounted to the base member such that a constant spacing is provided between the curved surface and the base member. That is, there is no eccentric relationship that is curved surface 28 has a cross section which is a portion of the circumference of a circle, and the axis of rotation with respect to that curved surface is not off center such as would create an eccentric relationship. The constant spacing between the curved surface 28 and base member 12 is substantially equal to the thickness of the compressed layers of the tube. In other words, when tube 30 is compressed, there are two layers of the materials (shown at 31) which make up the tube between curved surface 28 and base member 12 which is comprised of flat surface 16 and flange 28. In a preferred embodiment, for typical tubing manufactured today, the spacing would be 0.020 inch. However, it is understood that various other spacing may be selected to adapt to various collapsible tube containers made of differing thicknesses of material. Typical thickness of toothpaste tubing is approximately 0.010 inch, and therefore two layers of the tubing would be 0.020 inch. Some types of caulking tubing may have slightly greater thickness, but they have been found to work adequately with a spacing of 0.020 inch. In any event, the spacing is selected to be substantially equal to the thickness of the double layers of the compressed tube. Additionally, it is understood that compressing member 14 may be pivotally mounted to base member 12 by various suitable pivotal connections, other than the specific arrangement shown in the drawings.

Curved surface 28 may be provided with a friction enhancing structure 32, which may preferably be ridges running parallel to the axis of rotation of the curved surface 28. This is best illustrated in FIG. 2. However, it is understood that the friction engaging structure may be any suitable friction engaging structure such as knurling or the like.

Compressing member 14 may be provided with reinforcing ribs 34 to provide enhanced structural rigidity. The complete tube compressing apparatus, including base member 12 and compressing member 14, is preferably molded from a synthetic plastic material. More specifically, at present, by way of example, but not by way of limitation, the tube compressing apparatus is preferably molded from high impact polystyrene. However, it is understood that various other suitable synthetic plastic materials may be utilized, such as acrylonitrile-butadiene-styrene copolymer (ABS). Further, any other suitable rigid material may be utilized in practicing the invention including various metals, including stainless steel and others.

Figure 5:
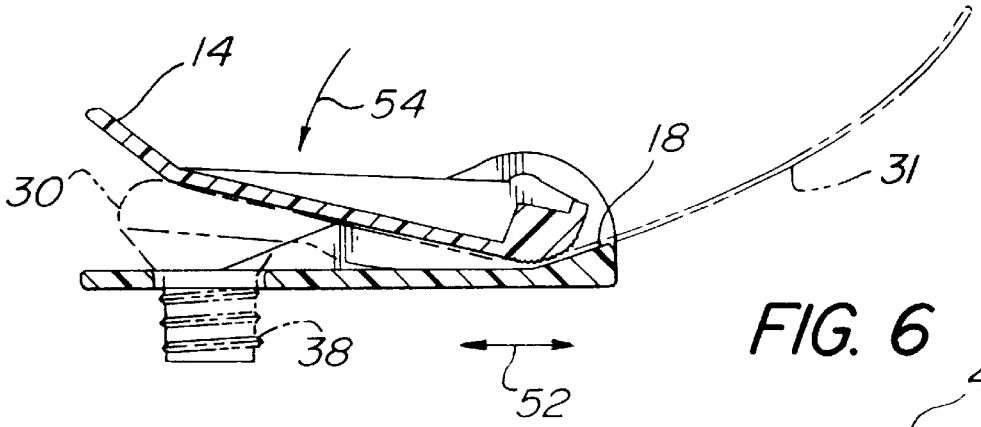
FIG. 5 is a cross sectional view through an apparatus of the present invention wherein the apparatus is utilized to compress the last remaining flowable material through the outlet of the tube where the outlet of the tube is bent at approximately 90 degrees to the body of the tube.

In a presently preferred embodiment, base member 12 is provided with a hole or opening 36. Hole or opening 36 is adapted to receive outlet 38 of tube 30 where outlet 38 is bent substantially at a right angle to the body of tube 30. Flange 18 is mounted at a first end 40 of base member 12 and hole 36 is formed near a second end 42 of base member 12. As is best illustrated in FIG. 5, with outlet 38 being bent substantially at a right angle to tube 30, substantially all of the flowable material within tube 30 may be compressed out of the tube by using compressing member 14. As illustrated in FIG. 5, the presently preferred embodiment would have a hole 36 diameter approximating or slightly larger than the outlet 38 with its cap removed. However, it is understood that hole 36 may be of a dimension which would be sufficient to accept outlet 38 with the cap thereon, with the cap portion 48 flipped to the open position. However, the presently preferred embodiment, by way of example, and not by way of limitation, is to have the opening 36 adapted to receive the outlet without the cap since many dispensing tubes do not provide a flip top cap. It is understood that the term outlet used herein and in the claims includes the outlet of the tube 30 whether the cap is removed or with a flip top cap.

Figure 4:
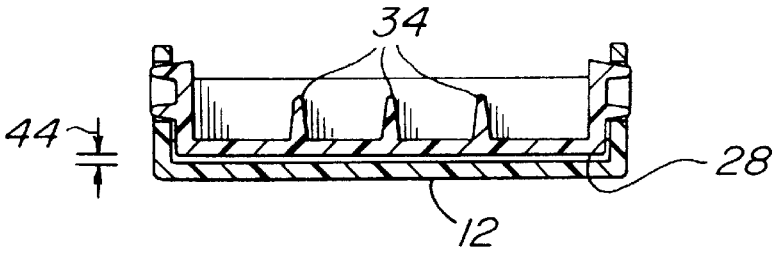
FIG. 4 is a cross sectional view taken along line 4—4 of FIG. 1.

The spacing between curved surface 28 and base member 12 may be seen in FIGS. 2 and 4. This spacing 44 remains constant independent of the rotatable position of compressing member 14 so long as curved surface 28 of compressing member 14 is juxtaposed base member 12. For example, when compressing member 14 is rotated in a clockwise direction, i.e. in the direction of arrow 50 such that curved surface 28 is no longer juxtaposed base member 12, the size of spacing therebetween increases dramatically. For example, when compressing member 14 is rotated more than 120 degrees in the direction of arrow 50 as shown in FIG. 2, there will be a large gap between compressing member 14 and base 12, allowing for ease of insertion or removal of a tube.

Figure 6:
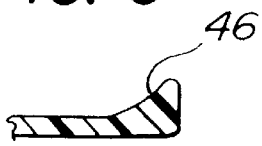
FIG. 6 is a cross sectional view of an alternate embodiment of the flange structure.

In a presently preferred embodiment, flange 18 has a substantially flat upper surface as illustrated in FIGS. 2 and 5. However, it is understood that flange 18 may have a surface which is somewhat curved, that is curves upwardly towards the first end 40. This curved flange 46 is illustrated in FIG. 6. This upwardly curving surface may be circular or provide a slight concave non-circular surface when viewed in cross section views similar to the view of FIGS. 2 and 5.

Flange 18, or the alternate curved flange 46, provides several functions including stiffening of the flat surface 16 of base member 12. Without this flange, the flat surface 16 may tend to bow slightly when the pressure is applied by compressing member 14, allowing some back flow of the flowable material towards first end 40. Flange 18, or its alternative 46, widens the area of predetermined spacing 44 or close tolerance providing more effective compression, that is widens the area in the direction of double headed arrow 52 or in the longitudinal direction of tube 30. Flange 18, or its alternative 46, also prevents the tube from sliding towards first end 40 during compression.

In operation, tube 30 may be inserted into tube compressor 10 by rotating compressing member 14 for more than 90 degrees in the direction of arrow 50 such that a large gap is provided between compressing member 14 and base member 16. The bottom end of tube 30 (the end opposite outlet 38) may be inserted into tube compressor 10 by inserting it in the direction of arrow 56 shown in FIG. 1. When it is desired to compress flowable materials out of tube 30, compressing member 14 is rotated in a direction opposite to that of arrow 50 with either the cap removed from outlet 38 or the flip top cap 48 flipped to the open position. When flowable material, such as toothpaste, is not being expressed, a cap may be replaced on outlet 38 or flip top cap 48 closed. When all of the material has been compressed out of a portion of tube 30, such as shown at 31 in FIG. 2, which may occur after multiple uses, tube 30 may need to be advanced further in the direction of arrow 56 in FIG. 1. Again, this may be most readily accomplished by rotating compressing member 14 in the direction of arrow 50 to increase the space between compressing member 14 and base 12 to allow ease of movement of tube 30 further into compressing apparatus 10. Alternatively, the tube may be forced in to the extent that it has been partially emptied without rotating compressing member 14 in the direction of arrow 50. Flowable material may again be compressed out of the tube as previously described. Such operations may be continued until tube 30 is almost completely emptied. At that point in time, assuming the option of the preferred embodiment of providing base member 12 with a hole or opening 36 is utilized, the outlet 38 of tube 30 may be bent substantially at a right angle of 90 degrees the remainder of the tube of the tube 30 as illustrated in FIG. 5, and outlet 38 may be inserted into opening 36. Pressing on compressing member 14 in the direction of arrow 54 substantially expresses all of the flowable material out of tube 30. After tube 30 is completely emptied, compressing member 14 may be moved in the direction of arrow 50, empty tube 30 removed and a new tube inserted.

In view of the above, the present invention may be embodied in other specific forms without departing from the spirit or essential attributes thereof and, accordingly, reference should be made to the appended claims, rather than to the foregoing specification as indicating the scope of the invention.

I claim:

1. An apparatus for compressing a flowable material out of a tube, comprising:

a base member, said base member including at a first end a flange rising at a predetermined angle to a flat surface of said base member;

a compressing member pivotally mounted to said base member in proximity to said first end, said compressing member being provided with a compressing flat surface and a compressing curved surface, said curved surface forming in cross section a sector of substantially circular shape having an axis of rotation coincident with an axis of rotation of the pivotally mounted compressing member; and said compressing member being pivotally mounted to said base member such that a constant spacing is mounted between said curved member and said base member, said constant spacing being substantially equal to the thickness of compressed layers of said tube.

2. An apparatus for compressing a flowable material out of a tube in accordance with claim 1 wherein said curved surface is provided with a friction enhancing structure.

3. An apparatus for compressing a flowable material out of a tube in accordance with claim 2 wherein said friction enhancing surface is comprised of ridges running parallel to the axis of rotation of said curved surface of said compressing member.

4. An apparatus for compressing a flowable material out of a tube in accordance with claim 1 wherein said flange is provided with supporting ribs mounted perpendicular to a surface of said flange.

5. An apparatus for compressing a flowable material out of a tube in accordance with claim 1 wherein said base member and said compressing member are comprised of a synthetic plastic material.

6. An apparatus for compressing a flowable material out of a tube in accordance with claim 5 wherein said synthetic plastic material is high impact polystyrene.

7. An apparatus for compressing a flowable material out of a tube in accordance with claim 1 including a hole formed in said flat surface of said base member near a second end of said base member, said hole being adapted to receive an outlet of said tube where said outlet is bent substantially at a right angle to said tube.

8. An apparatus for compressing flowable material out of a tube in accordance with claim 1 wherein said flange has a substantially flat surface.

9. An apparatus for compressing flowable materials out of a tube in accordance with claim 1 wherein said flange has a concave surface.

10. An apparatus in accordance with claim 1 where said sector of substantially circular shape is a sector of approximately 90 degrees.

11. An apparatus in accordance with claim 1 wherein said predetermined angle between said flat surface of said base member and a flat surface of said flange is approximately 160 degrees.

12. An apparatus in accordance with claim 1 wherein said flange is adapted to provide rigidity to said flat surface of said base member to prevent bowing of said flat surface during compression.

13. An apparatus in accordance with claim 10 wherein said sector of substantially circular shape ends so that the spacing increases when said compressing member is rotated to an angle wherein said circular shape and said base member are no longer juxtaposed to enable ease of insertion or removal of a tube.

* * * * *

UNITED STATES PATENT AND TRADEMARK OFFICE

CERTIFICATE OF CORRECTION

PATENT NO. : 6,234,353 B1
DATED : May 22, 2001
INVENTOR(S) : Homer E. Light

It is certified that error appears in the above-identified patent and that said Letters Patent is hereby corrected as shown below:

Column 1,
Line 34, before "Shmelkin;" insert -- - --.

Column 3,
Line 29, before "that" insert -- , --.
Line 29, before "curved" insert -- the --.

Column 6,
Line 3, delete "mounted" and substitute therefor -- maintained --.

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*